US011174864B2

(12) United States Patent
Schnurr et al.

(10) Patent No.: US 11,174,864 B2
(45) Date of Patent: Nov. 16, 2021

(54) VANE-TYPE GAS PUMP

(71) Applicant: PIERBURG PUMP TECHNOLOGY GMBH, Neuss (DE)

(72) Inventors: Steffen Schnurr, Essen (DE); Sebastian Cramer, Pulheim (DE); Nabil Salim Al-Hasan, Korschenbroich (DE); Stanislaus Russ, Moenchengladbach (DE); Tobias Gruene, Arnsberg (DE)

(73) Assignee: PITERBURG PUMP TECHNOLOGY GMBH, Neuss (DE)

( * ) Notice: Subject to any disclaimer, the term of this patent is extended or adjusted under 35 U.S.C. 154(b) by 235 days.

(21) Appl. No.: 16/481,834

(22) PCT Filed: Feb. 23, 2017

(86) PCT No.: PCT/EP2017/054143
§ 371 (c)(1),
(2) Date: Jul. 30, 2019

(87) PCT Pub. No.: WO2018/141419
PCT Pub. Date: Aug. 9, 2018

(65) Prior Publication Data

US 2019/0345936 A1 Nov. 14, 2019

(30) Foreign Application Priority Data

Feb. 1, 2017 (WO) ..... PCT/EP2017/052169

(51) Int. Cl.
*F01C 21/08* (2006.01)
*F01C 21/10* (2006.01)
(Continued)

(52) U.S. Cl.
CPC ..... *F04C 18/3441* (2013.01); *F04C 25/02* (2013.01); *F04C 29/124* (2013.01); *F04C 2240/30* (2013.01); *F04C 2240/40* (2013.01)

(58) Field of Classification Search
CPC .... F04C 18/3441; F04C 18/356; F04C 25/02; F04C 29/124; F04C 2/344; F01C 21/0809; F01C 21/108
See application file for complete search history.

(56) References Cited

U.S. PATENT DOCUMENTS 3,433,166 A * 3/1969 Birkemeier ..... F01C 21/108 418/108
4,799,867 A * 1/1989 Sakamaki ..... F04C 18/3442 418/1
(Continued)

FOREIGN PATENT DOCUMENTS

CN 105899810 A 8/2016
DE 199 37 704 A1 2/2001
(Continued)

*Primary Examiner* — Deming Wan
(74) *Attorney, Agent, or Firm* — Norman B. Thot

(57) ABSTRACT

A vane-type gas pump includes a pump housing which forms a pump chamber in which a pump rotor with at least one slidable sliding element is rotatably mounted. At least one fluid inlet opening and at least one fluid outlet opening are dedicated to the pump chamber. The pump housing includes a closed stroke ring, a first separate thrust washer, and a second separate thrust washer. At least one stroke ring adjustment device axially clamps the closed stroke ring directly to the first separate thrust washer. At least one separate housing clamping device axially clamps the first separate thrust washer, the closed stroke ring, and the second separate thrust washer together.

10 Claims, 2 Drawing Sheets

(51) Int. Cl.

| | |
|---|---|
| ***F04C 18/344*** | (2006.01) |
| ***F04C 25/02*** | (2006.01) |
| ***F04C 29/12*** | (2006.01) |
| ***F04C 18/356*** | (2006.01) |
| ***F04C 2/344*** | (2006.01) |

(56) References Cited

U.S. PATENT DOCUMENTS

| | | | | |
|---|---|---|---|---|
| 5,100,308 | A | 3/1992 | Gevelhoff et al. | |
| 2006/0140806 | A1 | 6/2006 | Sato | |
| 2007/0261237 | A1* | 11/2007 | Vogel ..... | C21D 1/18<br>29/888 |
| 2011/0138885 | A1 | 6/2011 | Kobayashi et al. | |
| 2016/0333877 | A1 | 11/2016 | Tsuda | |

FOREIGN PATENT DOCUMENTS

| | | | |
|---|---|---|---|
| EP | 2 568 180 | A1 | 3/2013 |
| JP | S58-90334 | | 6/1983 |
| JP | S62-99684 | A | 5/1987 |
| JP | H5-70116 | | 8/1995 |
| JP | H9-209954 | | 8/1997 |
| JP | 2003-269349 | A | 9/2003 |
| JP | 4718831 | B2 | 4/2011 |
| WO | WO 2010/007864 | A1 | 1/2010 |

* cited by examiner

VANE-TYPE GAS PUMP

CROSS REFERENCE TO PRIOR APPLICATIONS

This application is a U.S. National Phase application under 35 U.S.C. § 371 of International Application No. PCT/EP2017/054143, filed on Feb. 23, 2017 and which claims benefit to International Patent Application No. PCT/EP2017/052169, filed on Feb. 1, 2017. The International Application was published in German on Aug. 9, 2018 as WO 2018/141419 A1 under PCT Article 21(2).

FIELD

The present invention relates to a vane-type gas pump.

BACKGROUND

Vane-type gas pumps are known from the state of the art and are used in vehicles as so-called vacuum pumps, usually in combination with a brake power unit. The vane-type pump provides the negative pressure required for operating the brake power unit, wherein the negative pressure is normally 100 mbar absolute or less.

The vane-type gas pumps known from the state of the art usually comprise a pump housing surrounding a pump chamber, wherein a pump rotor is arranged in the pump chamber. The pump rotor is operated by an electric motor or mechanically by a combustion engine and comprises several radially slidable sliding elements. Two adjacent sliding elements delimit together with the pump rotor and the pump housing, respectively, one rotating pump compartment. If the pump rotor rotates, the sliding elements are displaced due to the centrifugal force acting on the sliding elements so that they abut with their respective head on one circumferential wall of the pump chamber. The pump housing is provided with a fluid inlet opening and at least one fluid outlet opening, wherein the fluid inlet opening and the fluid outlet opening are dedicated to the pump chamber.

Such a vane-type gas pump is described in EP 2 568 180 A1. The vane-type gas pump comprises a pump housing comprising a stroke ring, a first separate thrust washer, and a second separate thrust washer, wherein the first thrust washer is arranged on a first front side of the stroke ring, and the second thrust washer is arranged on a second front side of the stroke ring. The stroke ring is radially mounted and aligned relative to the first thrust washer by centering pins. The radial alignment of the stroke ring adjusts a sealing gap that occurs between the inner circumferential surface of the stroke ring and the outer circumferential surface of the pump rotor and largely prevents a gas flow between the fluid inlet opening and the fluid outlet opening. The final mounting of the thrust washers and the stroke ring is carried out by housing screws, which axially clamp the first thrust washer, the second thrust washer, and the stroke ring together in a sandwich-like manner.

A disadvantage of the embodiment described in EP 2 568 180 A1 is that the stroke ring is radially positioned exclusively by the centering pins. The relatively small sealing gap to be adjusted is thus affected by the manufacturing tolerances of the centering pins, the centering pin bores in the stroke ring, and the pump rotor, whereby a precise adjustment of the sealing gap is made difficult. The procedure for precisely adjusting the sealing gap is therefore complex and error-prone.

SUMMARY

An aspect of the present invention is to provide a vane-type gas pump with a simplified mounting.

In an embodiment, the present invention provides a vane-type gas pump which includes a pump housing which is configured to form a pump chamber in which a pump rotor comprising at least one slidable sliding element is rotatably mounted. At least one fluid inlet opening and at least one fluid outlet opening are dedicated to the pump chamber. The pump housing comprises a closed stroke ring, a first separate thrust washer, and a second separate thrust washer. At least one stroke ring adjustment device is configured to axially clamp the closed stroke ring directly to the first separate thrust washer. At least one separate housing clamping device is configured to axially clamp the first separate thrust washer, the closed stroke ring, and the second separate thrust washer together.

BRIEF DESCRIPTION OF THE DRAWINGS

The present invention is described in greater detail below on the basis of embodiments and of the drawings in which.

DETAILED DESCRIPTION

Figure 1:
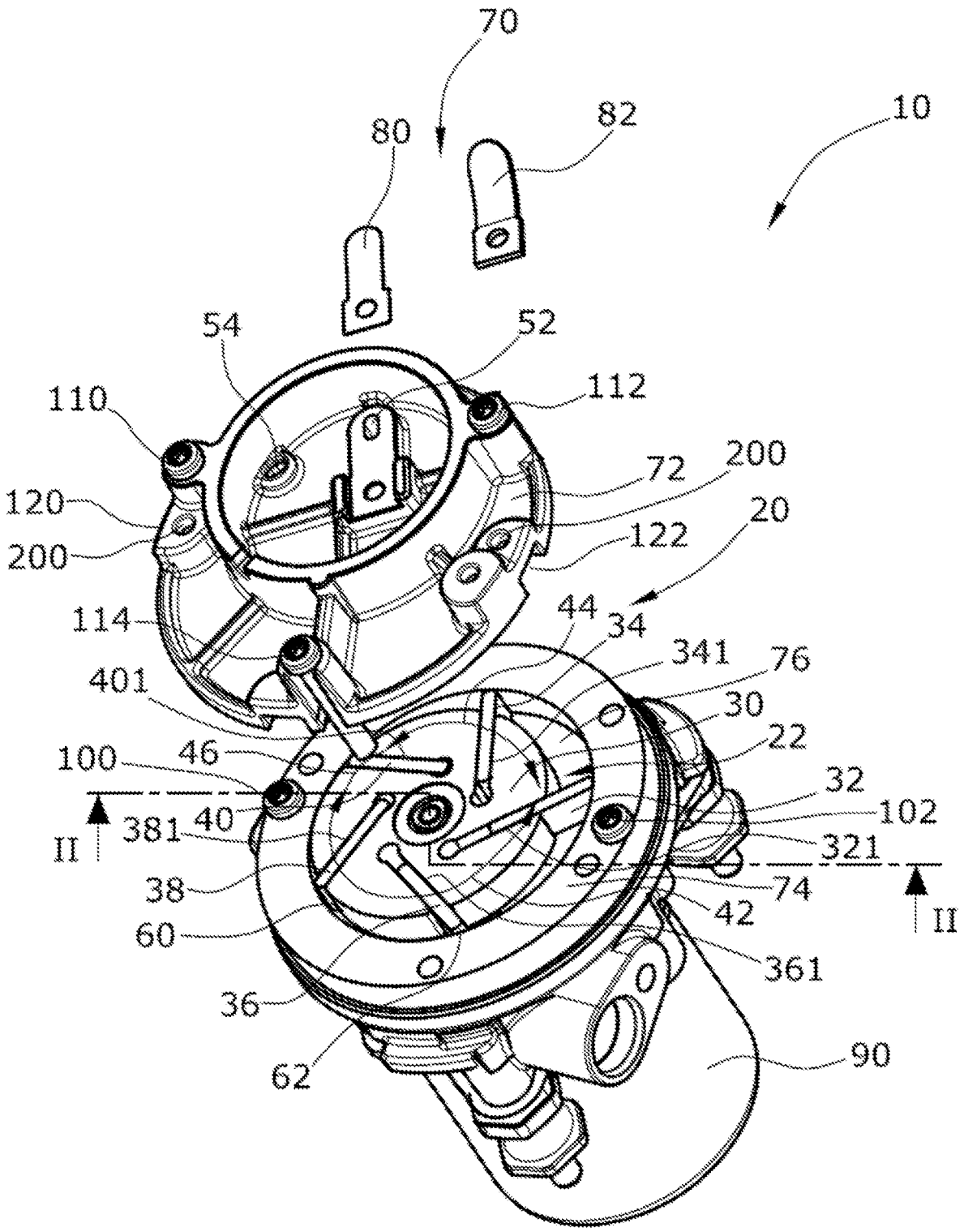
FIG. 1 shows an exploded view of a dry-running vane-type gas pump.

The gas pump comprises a pump housing forming a pump chamber. A pump rotor is arranged in the pump chamber that is either operated electrically by an electric motor or mechanically by a combustion engine. The pump rotor is arranged eccentrically in the pump chamber and forms, together with the circumferential wall of the pump chamber, a sealing gap defining the sealing sector, whereby a crescent-shaped working chamber is defined outside of the sealing sector.

The pump housing comprises a first thrust washer, a separate second thrust washer, and a separate stroke ring. The stroke ring is axially clamped by at least one stroke ring adjusting device to the first thrust washer. The second thrust washer is connected to the first thrust washer by at least one separate housing clamping device, wherein the first thrust washer, the stroke ring axially arranged between the two thrust washers, and the second thrust washer are clamped together in a sandwich-like manner by the at least one separate housing clamping device.

At least one slidable sliding element is arranged in the pump rotor. For mounting the at least one sliding element, the pump rotor comprises at least one sliding slot in which the at least one sliding element is displaceably arranged. For a rotating pump rotor, the at least one sliding element is displaced due to the centrifugal force acting on the sliding element so that the sliding element always abuts with its head on the circumferential wall of the pump chamber and follows the pump chamber. The at least one sliding element can also be spring-loaded so that the head of the at least one sliding element abuts on the circumferential wall of the pump chamber due to the centrifugal force, even at low revolutions.

The pump chamber is divided according to its function into an inlet sector, an outlet sector, and the sealing sector. A fluid inlet opening is arranged in the inlet sector which, when mounted, is in fluid communication, for example, with a low-pressure chamber of a brake power unit and which evacuates the low-pressure chamber. A fluid outlet opening is arranged in the outlet sector, wherein the pump chamber is in fluid communication with the atmospheric environment via the fluid outlet opening. The sealing sector is arranged between the fluid outlet opening and the fluid inlet opening in the rotational direction of the rotor. A gas flow is largely prevented between the fluid inlet opening and the fluid outlet opening in the sealing sector. A narrow sealing gap in the tenth of a millimeter range is adapted therefor in the sealing sector between the outer circumferential surface of the circular pump rotor and the inner circumferential surface of the stroke ring.

In the mounting process, the first thrust washer and the stroke ring are first mounted together. The stroke ring is first placed on the first thrust washer and is slightly attached by at least one stroke ring adjusting device, for example, a threaded screw, so that the stroke ring is axially fixed but can still be displaced radially by overcoming a certain static friction. A pump rotor gauge is then mounted, for example, an adjustment pump rotor, which has, compared to the actual working pump rotor, a slightly larger circular outer diameter, for example, a radius increased by 0.1 mm. The mounted adjustment pump rotor thereby defines the final gap size between the working pump rotor and the stroke ring. The stroke ring is brought in a radial direction so as to abut on the adjustment pump rotor. The stroke ring is finally fixed in this position on the first thrust washer by finally fixing the stroke ring via the stroke ring adjustment device so that the radial position of the stroke ring can no longer be changed.

The stroke ring adjustment device clamps the stroke ring so that the stroke ring is only fixed by the friction of the front side abutting on the first thrust washer and the head friction of the stroke ring adjustment device. The adjustment pump rotor is removed in the next step, and the working pump rotor as well as the sliding elements are mounted. The second thrust washer is then mounted by the separate housing clamping device, wherein the first thrust washer, the stroke ring axially arranged between the two thrust washers, and the second thrust washer are clamped together in a sandwich-like manner by the housing clamping device. Only the two thrust washers are directly clamped together by the housing clamping device.

By mounting the stroke ring in such a way, the gap size in the sealing sector between the stroke ring and the pump rotor can be reliably adjusted in a simple and cost-effective way, wherein the manufacturing tolerances of the components have significantly less effect on the adjusted gap size.

In an embodiment, the at least one stroke ring adjustment device can, for example, be a threaded screw or a threaded bolt with a threaded nut. The first thrust washer comprises a bore with an internal thread into which the threaded screw or the threaded bolt is screwed or has already been screwed. The threaded bolt comprises a thread on both axial endings, wherein the threaded bolt is screwed into the first thrust washer with a thread and the other thread is provided for the threaded nut via which the stroke ring is axially clamped directly to the first thrust washer. The screw head of the threaded screw or the threaded nut abut on the front side facing away from the first thrust washer.

In an embodiment, the stroke ring can, for example, be axially clamped to the first thrust washer by exactly two stroke ring adjustment devices, whereby a relatively even surface pressure prevails between the front side of the stroke ring and the first thrust washer.

In an embodiment, the at least one stroke ring adjustment device can, for example, be put through a through bore formed in the stroke ring, wherein the diameter of the through bore is larger than the diameter of the stroke ring adjustment device, for example, a few millimeters larger. The attached stroke ring can thus be radially displaced, and the radial gap size in the sealing sector can be adjusted. Instead of the through bore, the stroke ring can alternatively comprise a groove which is open in the radial direction.

In an embodiment, the second thrust washer can, for example, comprise a recess in the area of the at least one stroke ring adjustment device, whereby the second thrust washer can be easily mounted. It is not necessary to completely sink the stroke ring adjustment device into the stroke ring. The second thrust washer can comprise a bore coaxially to the stroke ring adjustment device, whereby the gap size can still be adjusted when all housing components are already assembled, wherein all stroke ring adjustment devices and all housing clamping devices must be partially loosed for a readjustment.

In an embodiment, the vane-type gas pump can, for example, be a dry-running vane-type gas pump so that no lubricants are directed into the pump chamber. The dry-running gas pump does not comprise a lubricant connection. In an oil-lubricated gas pump, the lubricant is, for example, used to seal the sealing gap in the sealing sector. By omitting the lubricants, the sealing is no longer provided, so that for dry-running gas pumps it is particularly important to precisely adjust a very narrow sealing gap in order to achieve a good pneumatic efficiency. The gap size should, for example, be a maximum of 0.2 mm, for example, 0.1 mm.

In an embodiment, one stroke ring adjustment device and one housing clamping device are respectively arranged adjacent to each other, as viewed in a circumferential direction.

The axial clamping of the stroke ring to the first thrust washer can be achieved by a direct connection or by an indirect connection. The stroke ring adjustment device can, for example, be put through the through bore formed in the stroke ring and through a through bore formed in the first thrust washer, and can be screwed into a thread formed in a housing or a flange so that the first thrust washer is clamped between the stroke ring and the flange or the housing.

In an embodiment, the stroke ring can, for example, be screwed directly to the first thrust washer by the at least one stroke ring adjustment device, wherein the stroke ring adjustment device is put through the through bore formed in the stroke ring, and wherein the stroke ring adjustment device in screwed into a thread formed in the first thrust washer.

The present invention is described in greater detail below under reference to the drawings.

Figure 2:
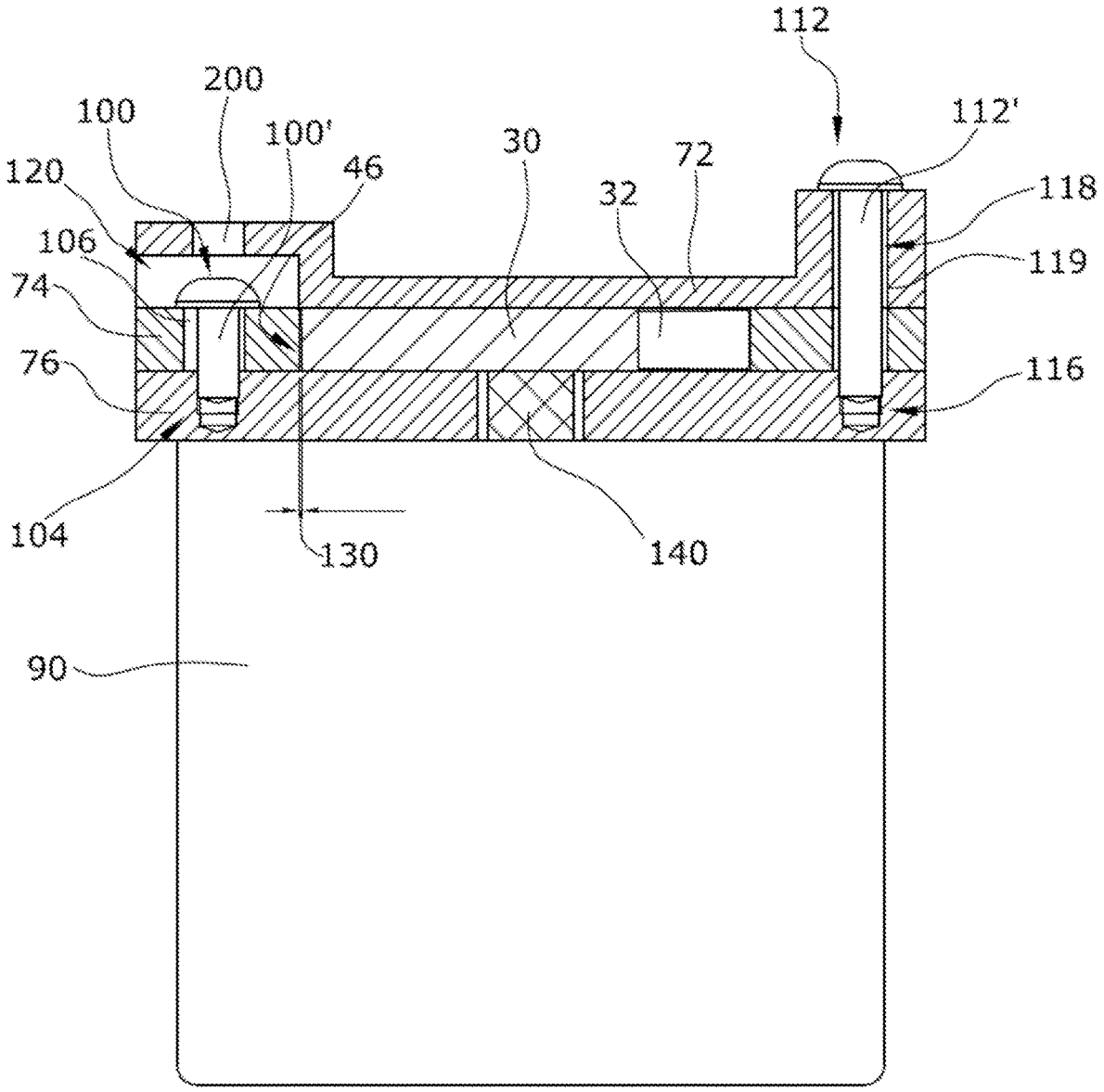
FIG. 2 shows a cross-sectional view of the dry-running vane-type gas pump from FIG. 1.

FIGS. 1 and 2 show a vane-type gas pump 10 formed as a so-called vacuum pump, which is, for example, designated to be used in vehicles and which can create an absolute pressure of 100 mbar or more. The dry-lubricated vane-type gas pump 10 comprises a metal pump housing 20 surrounding a pump chamber 22. The pump housing 20 substantially comprises a stroke ring 74, a separate first thrust washer 76, and a separate second thrust washer 72. In the pump chamber 22, a circular pump rotor 30 is rotatably arranged eccentrically to the center of gravity of the pump chamber 22 and is connected non-rotatably to an electric motor 90 by a drive shaft 140.

The pump rotor 30 comprises five sliding slots 321, 341, 361, 381, 401 in which one sliding element 32, 34, 36, 38, 40 is respectively displaceably mounted. The five sliding elements 32, 34, 36, 38, 40 are not oriented exactly radially, but are tilted and divide the pump chamber 22 into five rotating pump compartments that each have the same pump compartment angle a of approximately 70°. The pump rotor 30 is driven by the electric motor 90.

The pump chamber 22 can be divided into several sectors, namely, an inlet sector 42 with a fluid inlet opening 60, an outlet sector 44 with a first fluid outlet opening 52 and a second fluid outlet opening 54, and a sealing sector 46. The sealing sector 46 is arranged between the outlet sector 44 and the inlet sector 42, as viewed in a rotational direction, and prevents a gas flow from the fluid outlet openings 52, 54 to the fluid inlet opening 60.

The fluid inlet opening 60 is formed in the first thrust washer 76. The two fluid outlet openings 52, 54 are formed in the second thrust washer 72. The first fluid outlet opening 52 is arranged in the rotational direction of the pump rotor 30 before the second fluid outlet opening 54. A check valve 70 is fluidically dedicated to the first fluid outlet opening 52, wherein the check valve 70 is a reed valve and comprises a valve reed 80 and a path delimiter 82 which are both fixedly arranged on the second thrust washer 72.

In the mounting process of the vane-type gas pump 10, the pump rotor 30 and the stroke ring 74 are first mounted on the first thrust washer 76, wherein the stroke ring 74 is abutted radially on the pump rotor 30, a gap size 130 is adjusted in the sealing sector 46 between the pump rotor 30 and the stroke ring 74, and the stroke ring 74 is finally clamped in the adjusted position by the two stroke ring adjustment devices 100, 102. The gap size 130 can, for example, be adjusted with a spring gauge. Threaded screws 100', 102' (whereby only threaded screw 100' is shown in FIG. 2) are used as the stroke ring adjustment devices 100, 102 which can be put through the through bore 106 formed in each stroke ring 74, and which can be screwed into one respective interior thread 104 formed in the first thrust washer 76. The through bore 106 is several millimeters larger than the diameter of the stroke ring adjustment device 100, 102 so that the stroke ring 74 is radially slidable and thus the gap size 130 between the pump rotor 30 and the stroke ring 74 in the sealing sector 46 can be adjusted. A dummy rotor can alternatively be used to adjust the gap size 130.

The stroke ring adjustment devices 100, 102 clamp the stroke ring 74 so that the stroke ring 74 is only fixed by the friction of the front side abutting on the first thrust washer 76 and by the head friction of the stroke ring adjustment devices 100, 102. The second thrust washer 72 comprises two recesses 120, 122, wherein one recess 120, 122 is dedicated to one respective stroke ring adjustment device 100', 102'. The second thrust washer 72 further comprises a bore 200 arranged coaxially to each stroke ring adjustment device 100, 102. The bores 200 allow a gap size to be adjusted when all housing components have already been assembled.

In the following step, the second thrust washer 72 is mounted by three separate housing clamping devices 110, 112, 114, wherein each housing clamping device 110, 112, 114 is put through one respective through bore 118 formed in the second thrust washer 72 and through one respective larger through bore 119 formed in the stroke ring 74, and is screwed into one respective interior thread 116 formed in the first thrust washer 76. FIG. 2 shows a threaded screw 112' being used as the housing clamping device 112.

The first thrust washer 76, the stroke ring 74 axially arranged between the first thrust washer 72 and the second thrust washer 76, and the second thrust washer 72 are thereby axially clamped together in a sandwich-like manner.

By mounting the stroke ring 74 as described above, the gap size 130 in the sealing sector 46 between the stroke ring 74 and the pump rotor 30 can be adjusted in a simple and cost-effective way, wherein the manufacturing tolerances of the components have significantly less effect on the adjusted gap size 130.

It should be clear that other constructive embodiments of the dry-running gas pump are possible compared to the described embodiments without going beyond the scope of protection of the present invention. The number of sliding elements can, for example, vary or the fluid inlet opening and/or the fluid outlet opening can be formed on other housing components. Reference should also be had to the appended claims.

What is claimed is:

1. A vane-type gas pump comprising:

a pump housing which is configured to form a pump chamber in which a pump rotor comprising at least one slidable sliding element is rotatably mounted, at least one fluid inlet opening and at least one fluid outlet opening being dedicated to the pump chamber, the pump housing comprising, a closed stroke ring, a first separate thrust washer, and a second separate thrust washer;

at least one stroke ring adjustment device which is configured to axially clamp the closed stroke ring directly to the first separate thrust washer; and at least one separate housing clamping device which is configured to axially clamp the first separate thrust washer, the closed stroke ring, and the second separate thrust washer together, wherein, the second separate thrust washer comprises at least one bore, one of the at least one bore being arranged coaxially to each of the at least one stroke ring adjustment device so that a gap size between the closed stroke ring and the pump rotor is adjustable after the pump housing is assembled.

2. The vane-type gas pump as recited in claim 1, wherein the at least one stroke ring adjustment device is a threaded screw or a threaded bolt comprising a threaded nut.

3. The vane-type gas pump as recited in claim 1, wherein, exactly two stroke ring adjustment devices are provided as the at least one stroke ring adjustment device, and the closed stroke ring is axially clamped to the first separate thrust washer by the exactly two stroke ring adjustment devices.

4. The vane-type gas pump as recited in claim 1, wherein, the closed stroke ring comprises a through bore, the at least one stroke ring adjustment device is put through the through bore, and a diameter of the through bore is larger than a diameter of the at least one stroke ring adjustment device so that the closed stroke ring is adjustable relative to the first separate thrust washer.

5. The vane-type gas pump as recited in claim 1, wherein the second separate thrust washer comprises a recess in an area of the at least one stroke ring adjustment device.

6. The vane-type gas pump as recited in claim 1, wherein the vane-type gas pump is configured to be dry-running.

7. The vane-type gas pump as recited in claim 1, wherein the gap size between the closed stroke ring and the pump rotor is a maximum of 0.2 mm.

8. The vane-type gas pump as recited in claim 1, wherein the gap size between the closed stroke ring and the pump rotor is 0.1 mm.

9. The vane-type gas pump as recited in claim 1, wherein a respective one of the at least one stroke ring adjustment device and a respective one of the at least one housing clamping device are arranged adjacent to each other.

10. The vane-type gas pump as recited in claim 1, wherein the closed stroke ring is screwed directly to the first separate thrust washer by the at least one stroke ring adjustment device.

* * * * *